US007255617B2

(12) United States Patent
Yokoya et al.

(10) Patent No.: US 7,255,617 B2
(45) Date of Patent: Aug. 14, 2007

(54) PERSONAL WATERCRAFT INCORPORATING CAPSIZE-RECOVERY FACILITATING STRUCTURE, AND METHOD OF USING SAME

(75) Inventors: Noboru Yokoya, Saitama (JP); Takeshi Kimishima, Saitama (JP); Yasunori Okazaki, Saitama (JP); Takeshi Koyabu, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 34 days.

(21) Appl. No.: 11/229,077

(22) Filed: Sep. 16, 2005

(65) Prior Publication Data

US 2006/0063445 A1 Mar. 23, 2006

(30) Foreign Application Priority Data

Sep. 17, 2004 (JP) ..... 2004-272201

(51) Int. Cl.
*B63H 21/00* (2006.01)
*B63B 35/73* (2006.01)

(52) U.S. Cl. ..... 440/89 R; 114/55.51; 114/55.57

(58) Field of Classification Search ..... None
See application file for complete search history.

(56) References Cited

U.S. PATENT DOCUMENTS 4,117,795 A * 10/1978 Ruiz ..... 114/68
4,952,180 A * 8/1990 Watanabe et al. ..... 440/77
4,982,682 A * 1/1991 Hattori ..... 114/55.51
6,896,566 B2 * 5/2005 Takahashi et al. ..... 440/88 A

FOREIGN PATENT DOCUMENTS

JP 2002-002593 1/2002

* cited by examiner

*Primary Examiner*—Jesus Sotelo
*Assistant Examiner*—Daniel V. Venne
(74) *Attorney, Agent, or Firm*—Carrier, Blackman & Associates, P.C.; William D. Blackman; Joseph P. Carrier

(57) ABSTRACT

A personal watercraft can be rotated in a correct direction of rotation when the personal watercraft has been overturned, and can thereby be restored to a normal, upright position. The personal watercraft includes a vessel body, an engine, and an exhaust system. The exhaust system includes a muffler, disposed on a first side of the vessel body, and an exhaust pipe connected to the muffler and formed in an inverted U-shape. During operation of the engine, exhaust gas passes through the inverted-U-shaped exhaust pipe and is subsequently discharged to the outside environment via an exhaust port. The exhaust port is disposed on a second side of the vessel body opposite the first side. The vessel body has a hollow water-receiving portion formed therein, on the second side thereof. The water-receiving portion is adapted to be submerged under water when the personal watercraft is overturned in a body of water.

12 Claims, 6 Drawing Sheets

PERSONAL WATERCRAFT INCORPORATING CAPSIZE-RECOVERY FACILITATING STRUCTURE, AND METHOD OF USING SAME

CROSS-REFERENCE TO RELATED APPLICATIONS

The present invention claims priority under 35 USC 119 based on Japanese patent application No. 2004-272201, filed on Sep. 17, 2004. The subject matter of this priority document is incorporated by reference herein.

BACKGROUND OF THE INVENTION

1. Field of the Invention

The present invention relates to a personal watercraft incorporating structure for facilitating capsize recovery, and to a method of restoring an overturned watercraft to a normal, upright position. More particularly, the present invention relates to a personal watercraft and to a method of use thereof, in which the watercraft includes an inverted-U-shaped exhaust pipe disposed midway within an engine exhaust system, and further wherein the watercraft body includes specialized structure to assist a user in righting the watercraft, in the event that it overturns during operation.

2. Description of the Background Art

It is well known to provide a personal watercraft, or small planing boat, with an exhaust system for the driving engine thereof. It is also well known to incorporate a muffler in such an exhaust system, to which a substantially inverted-U-shaped exhaust pipe is connected. A personal watercraft having this configuration discharges exhaust gas in the muffler out through the exhaust pipe via an exhaust port. Such an exhaust system is disposed, for example, in Japanese Laid-Open Patent publication No. 2002-2593.

The art disclosed in Japanese Laid-Open Patent publication No. 2002-2593 will be described below with reference to FIG. 6. FIG. 6 illustrates the basic construction of a conventional prior art personal watercraft exhaust system.

As shown in FIG. 6, a prior art personal watercraft 100 includes an engine 101 that rotates a drive shaft 102 for driving a jet propeller 103. The personal watercraft 100 is propelled as the boat 100 expels water drawn in from a front end portion 103*a* of the jet propeller 103 rearwardly from a rear end portion 103*b* as a jet of water.

The personal watercraft 100 includes a substantially inverted-U-shaped exhaust hose 105 disposed midway within an exhaust system of the engine 101. The substantially inverted-U-shaped exhaust hose 105 functions to prevent water that has entered the exhaust hose 105 from entering into the engine 101 through a side thereof.

For example, if the personal watercraft 100 overturns in the water, an exhaust port of the exhaust hose 105 opens upwardly, making it likely that water will enter the exhaust hose 105 via the exhaust port. The water that has entered the exhaust hose 105 stays at a vertex portion 105*a* of the exhaust hose 105 formed into the substantially inverted-U shape, and does not enter the engine 101.

When the overturned personal watercraft 100 is to be restored to a normal, upright position, it is necessary to discharge the water remaining in the vertex portion 105*a* from the exhaust port. This is accomplished by turning the personal watercraft 100 such that the exhaust port is located downwardly.

To ensure that the water remaining in the vertex portion 105*a* is discharged properly, the personal watercraft 100 is marked, at a rear end portion thereof, with the proper direction of rotation of the overturned personal watercraft 100 when the overturned personal watercraft 100 is to be restored to a normal, upright position. Restoring the overturned personal watercraft 100 to the normal, upright position is, however, performed in a submerged condition. Therefore, it is difficult and time-consuming for an operator to determine the proper direction of rotation that is given at the rear end portion of a vessel body 100.

It is therefore an object of the present invention to provide a personal watercraft that can be swiftly rotated in a correct direction of rotation when the personal watercraft, that has been overturned, is to be restored to a normal, upright position.

SUMMARY

In accordance with one aspect of the present invention, there is provided a personal watercraft, including an exhaust system for an engine mounted in a vessel body. The exhaust system includes a muffler and an exhaust pipe connected to the muffler. The exhaust pipe extends upwardly a short distance, and then curves to extend downwardly to be formed into a substantially inverted U-shape. The exhaust gas in the muffler is discharged to the outside of the personal watercraft by way of the inverted-U-shaped exhaust pipe from an exhaust port of the exhaust pipe. The personal watercraft according to the first aspect of the present invention is characterized in the following points. Specifically, the muffler is disposed on one side (a first side) of the vessel body, and the exhaust port is disposed on the other side (a second, opposed side) of the vessel body, relative to the muffler. Further, the other side of the vessel body includes a water-receiving space capable of taking in water, the water-receiving space being submerged under water when the personal watercraft is in an overturned state.

When the personal watercraft is in an overturned state, the water-receiving space is submerged under water and water flows into the water-receiving space. Water collects in the water-receiving space and buoyancy on the second side of the vessel body becomes smaller than that on the first side thereof. Accordingly, the personal watercraft is inclined so that the second side of the vessel body is lowered.

Consider herein an attempt to restore the overturned personal watercraft to a normal, upright position. It is readily understood that restoration of the overturned personal watercraft to the normal, upright position is more easily accomplished if the lowered side is further lowered downwardly. It is therefore considered that an operator who makes the aforementioned attempt will normally rotate the personal watercraft in the direction of further lowering the second side, which has been previously in a lowered position, in his or her attempt to restore the personal watercraft to the normal, upright position.

Accordingly, in the first aspect of the present invention, the direction in which the second side, which has been previously lowered, is further lowered, is regarded as the correct direction of rotation. This allows the operator to swiftly rotate the personal watercraft in the correct direction without having to check the direction of rotation marked on the vessel body. Moreover, the rotation in the correct direction causes the muffler, disposed on the first side of the vessel body, to be raised and the exhaust port to be lowered. The water collected at a vertex portion of the substantially inverted-U-shaped exhaust pipe flows toward the side of the exhaust port, and is drained out of the personal watercraft from the exhaust port.

Pursuant to another aspect of the present invention, the water-receiving space is arranged so as to be located above the water, and to discharge water that has been taken therein when the personal watercraft is in a normal, upright position.

When the personal watercraft is in the normal, upright position, the water-receiving space is located above the water, and taken-in water discharges from the space. This allows a weight balance in a width direction of the personal watercraft to be maintained in equilibrium when the personal watercraft is normally operated.

According to the first aspect of the present invention, the correct direction of rotation of the personal watercraft is defined to be the direction of further lowering the other, second side that has been previously lowered. This provides the advantage that the operator can restore the personal watercraft to the normal, upright position by swiftly rotating the personal watercraft in the correct direction.

According to the second aspect of the present invention, when the personal watercraft is in the normal, upright position, the water-receiving space discharges water that has been taken therein. This provides the advantage that the personal watercraft can be propelled in a preferable condition by maintaining the weight balance in the width direction of the personal watercraft in equilibrium.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

BRIEF DESCRIPTION OF THE DRAWINGS

FIG. 3(*b*) is a cross-sectional view of the personal watercraft of FIG. 3*a* as viewed from the rear, showing personal water craft in an inclined orientation wherein the water-filled and less buoyant right side of the vessel is lower in the water than the left side of the vessel.

FIG. 4(*b*) is a cross-sectional view of the personal watercraft of FIG. 3*a* as viewed from the rear, showing the personal watercraft in a partially-righted orientation in which the water accumulated within the U-shaped exhaust pipe flows toward the exhaust port rather than the muffler as a result of rotation of the vessel body in the direction of arrow c.

DETAILED DESCRIPTION

A selected illustrative embodiment of the invention will now be described in some detail, with reference to the drawings. It should be understood that only structures considered necessary for clarifying the present invention are described herein. Other conventional structures, and those of ancillary and auxiliary components of the system, are assumed to be known and understood by those skilled in the art. For the purpose of this specification, "front," "rear," "left," and "right" denote corresponding directions as viewed from an operator of a personal watercraft. In addition, "Fr" denotes forward, "Rr" denotes rearward, "L" denotes leftward, and "R" denotes rightward.

Figure 1:
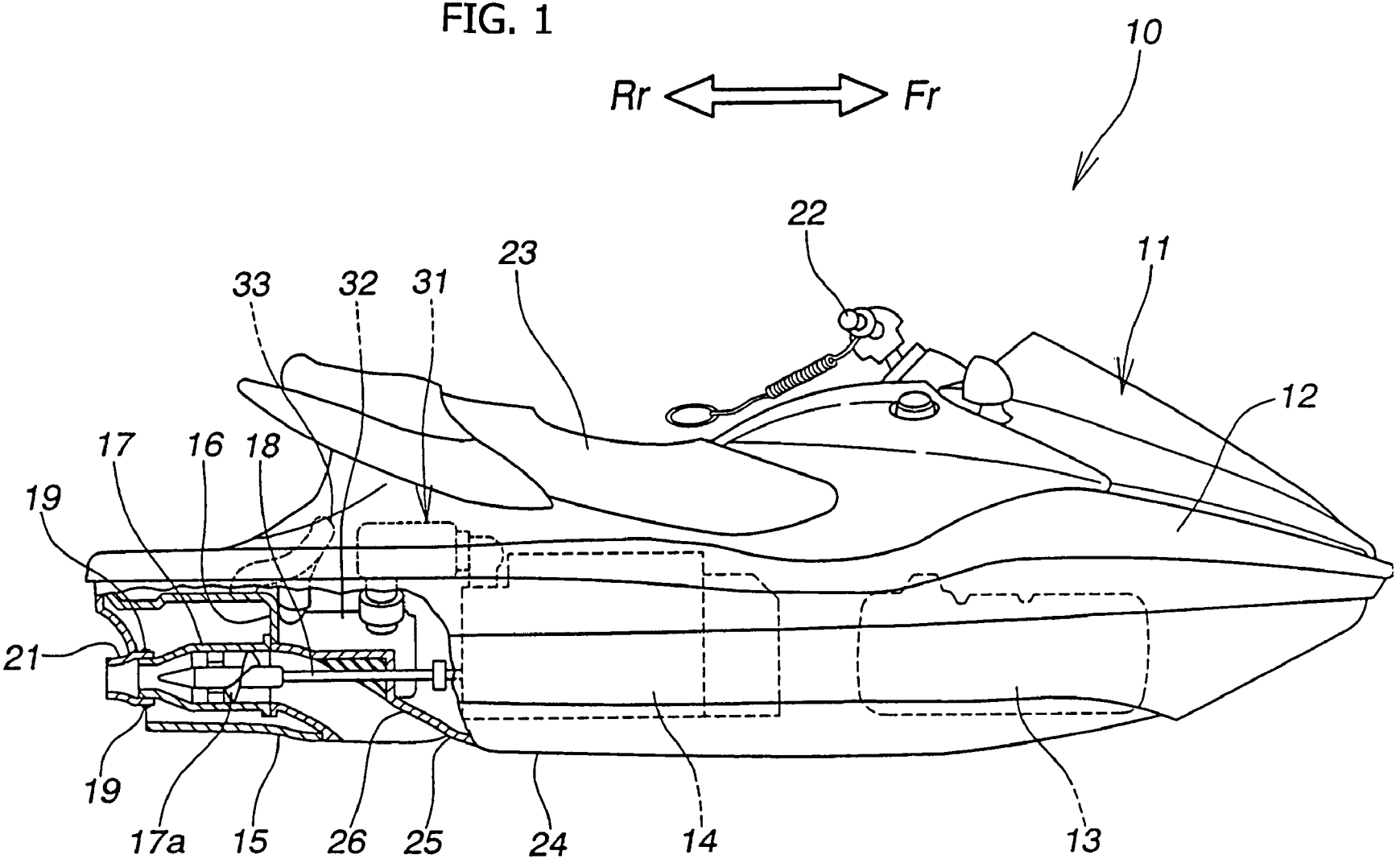
FIG. 1 is a side elevational view of a personal watercraft according to a preferred embodiment of the present invention, showing an exhausting system mounted within the vessel body rearward of an engine.

FIG. 1 is a side elevational view of a personal watercraft 10 according to a preferred embodiment of the present invention. The personal watercraft 10 according to the preferred embodiment of the present invention includes a vessel body 11, a fuel tank 13, an engine 14, a pump chamber 16, and a water jet propeller 17. The fuel tank 13 is disposed at a front portion 12 of the vessel body 11. The engine 14 is disposed rearward of the fuel tank 13. The pump chamber 16 is disposed at the stem (the rear portion of the vessel body) 15 located rearward of the engine 14. The water jet propeller 17 is disposed inside the pump chamber 16. An impeller 17*a* of the water jet propeller 17 is connected to the engine 14 via a drive shaft 18.

The personal watercraft 10 further includes a steering nozzle 21, a steering handlebar 22, and a seat 23. The steering nozzle 21 is disposed rearward of the water jet propeller 17 and is mounted swingably to the right and left via upper and lower pins 19, 19. The steering handlebar 22 swingably operates the steering nozzle 21 and is disposed above the fuel tank 13. The seat 23 is disposed rearward of the steering handlebar 22.

According to the personal watercraft 10, the engine 14 rotates the drive shaft 18, which, in turn, rotates the impeller 17*a*. As the impeller 17*a* rotates, water is drawn in to a water flow duct 26 through an intake port 25 in a hull bottom 24. The drawn-in water is further taken in to the water jet propeller 17 via the water flow duct 26. The water thus taken in the water jet propeller 17 is expelled rearwardly from the steering nozzle 21. The personal watercraft 10 is thereby propelled.

Figure 2:
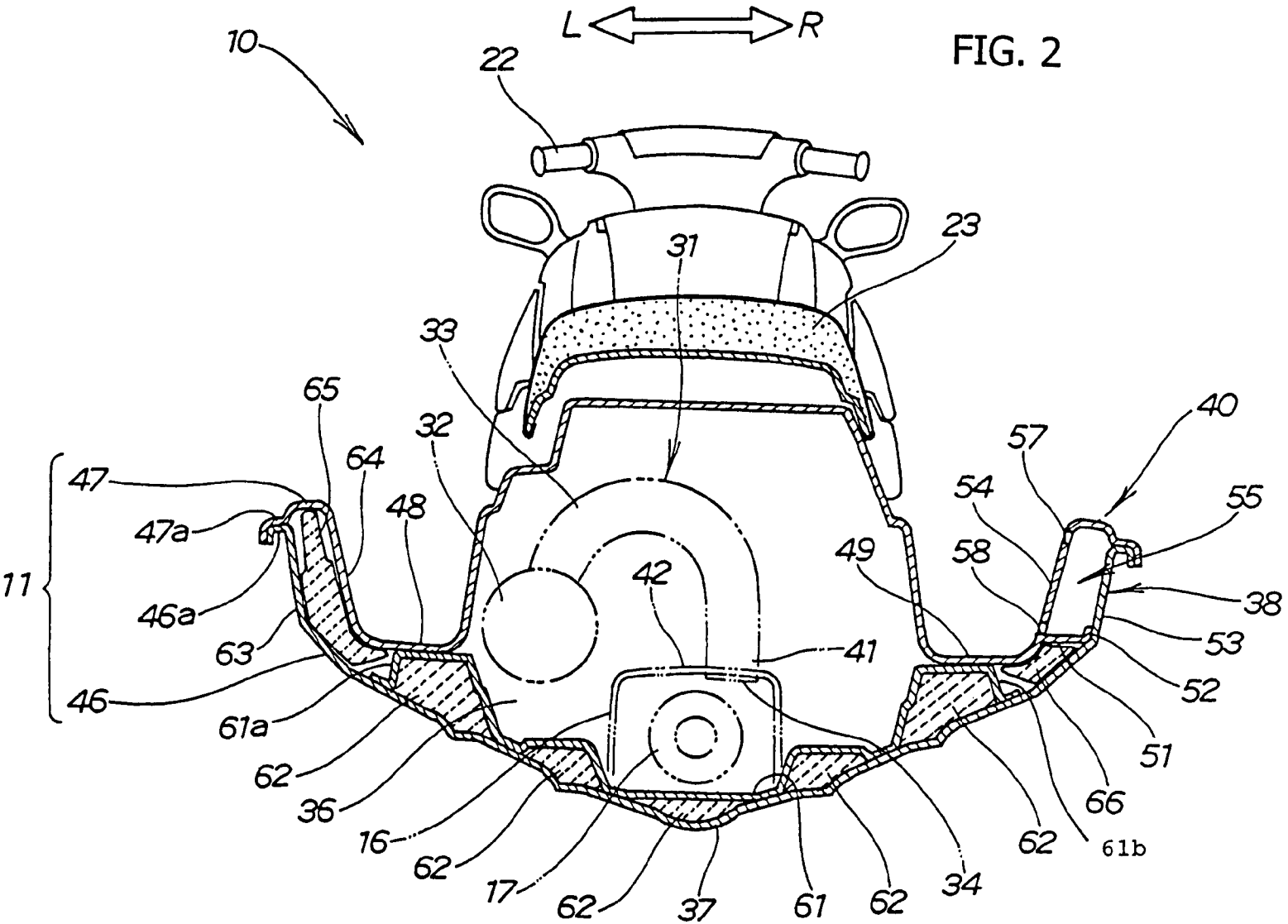
FIG. 2 is a cross-sectional view of the personal watercraft of FIG. 1 as viewed from the rear, showing the muffler mounted on a left side of the vessel body, the inverted U-shape of the exhaust pipe, and the exhaust port opening into an upper surface of the pump chamber.

FIG. 2 is a cross-sectional view of the personal watercraft 10 according to the preferred embodiment of the present invention. The personal watercraft 10 includes an exhaust system 31 for the engine mounted in the vessel body 11. The exhaust system 31 includes a muffler 32. An exhaust pipe 33 connected to the muffler 32 is formed into a substantially inverted U-shape. Specifically, the exhaust pipe 33 extends from the muffler 32 upwardly a short distance, and then curves to extend downwardly. The exhaust gas in the muffler 32 is discharged to the outside of the vessel body 11 by way of the exhaust pipe 33, through an exhaust port 34 of the exhaust pipe 33.

In accordance with the personal watercraft 10 according to the preferred embodiment of the present invention, the muffler 32 is disposed in a left-hand side space (one side of the vessel body) 36 of the vessel body 11. The exhaust port 34, on the other hand, is disposed on a right side portion (the other side of the vessel body) 38 of the vessel body 11 relative to the muffler 32. Specifically, the exhaust port 34 is disposed generally at a center 37 of the vessel body 11. There is provided a water-receiving portion 40 capable of taking in water at the right side portion 38 of the vessel body 11. The water-receiving portion 40 is submerged under water when the personal watercraft 10 is in an overturned state.

The exhaust system 31 is constructed as follows. Specifically, the muffler 32 is connected to the engine 14 (see FIG. 1) via an exhaust pipe (not shown) or the like. The substantially inverted-U-shaped exhaust pipe 33 is then connected to the muffler 32. A discharge side end portion 41 of the exhaust pipe 33 is passed through a ceiling wall 42 of the pump chamber 16. The exhaust port 34 at the discharge side end portion 41 is then made to face an inside of the pump chamber 16.

The vessel body 11 includes a hull 46 and a deck 47. The hull 46 forms a lower half section of the vessel body 11. The deck 47 forms an upper half section of the vessel body 11. A peripheral edge 47*a* of the deck 47 is bonded to a peripheral edge 46*a* of the hull 46. The deck 47 includes left and right foot portions 48, 49. A partition wall 51 extends substantially horizontally between the hull 46 and the deck 47 at a point near the right foot portion 49. The partition wall 51 includes a bent tab 52 at an outer end portion thereof.

The bent tab 52 is bonded to a right side wall 53 of the hull 46. A water-receiving space 55 is thereby defined by the right side wall 53 of the hull 46, a right side wall 54 of the deck 47, and the partition wall 51 of the deck 47. The right side wall 54 of the deck 47 is provided with a valveless upper through hole 57 at an upper portion of the water-receiving space 55. The right side wall 54 of the deck 47 is also provided with a valveless lower through hole 58 at a lower portion of the water-receiving space 55. Specifically, the right side wall 53 of the hull 46, the right side wall 54 of the deck 47, and the partition wall 51 of the deck 47 form the water-receiving portion 40. It will be noted that in the depicted embodiment, the through holes 57, 58 are formed in a portion of the deck 47 which defines a side wall of the right foot portion 49.

The water-receiving portion 40 is submerged under water in an overturned state. The water-receiving portion 40 is thus designed to take water in the water-receiving space 55 in the overturned state through both the upper and lower through holes 57, 58. In addition, the water-receiving portion 40 is arranged so as to be located above a water level (above the water) when the personal watercraft 10 is placed into a body of water and is oriented in a normal, upright position. The water-receiving portion 40 is further arranged such that water taken in the water-receiving space 55 is discharged from the lower through hole 58 to the outside when the personal watercraft 10 is in the normal position.

A plate 61 is mounted on an interior surface of the hull 46. Five floating bodies 62, formed, for example, of a foam material, are disposed in a space between the hull 46 and the plate 61. In addition, there is disposed a left floating body 65 in a space defined by a left end portion 61*a* of the plate 61, a left side wall 63 of the hull 46, and a left side wall 64 of the deck 47. Further, a right floating body 66 is disposed in a space defined by a right end portion 61*b* of the plate 61, a lower portion of the right side wall 53 of the hull 46, the right foot portion 49 of the deck 47, and the partition wall 51 of the deck 47.

Figure 3A:
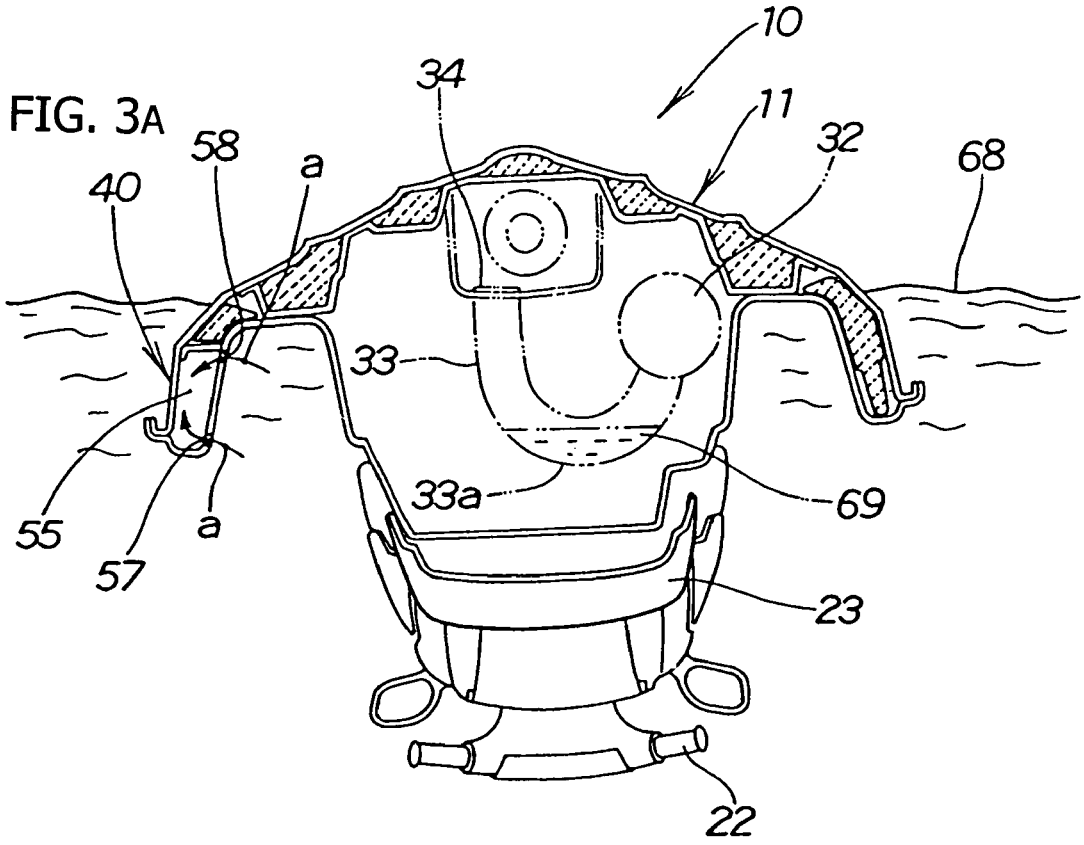
FIG. 3(*a*) is a cross-sectional view of the personal watercraft of FIG. 1 as viewed from the rear, showing the personal watercraft in an overturned state and showing water flowing into the water-receiving space formed on the right side of the vessel body, via two openings formed in the deck.
Figure 3B:
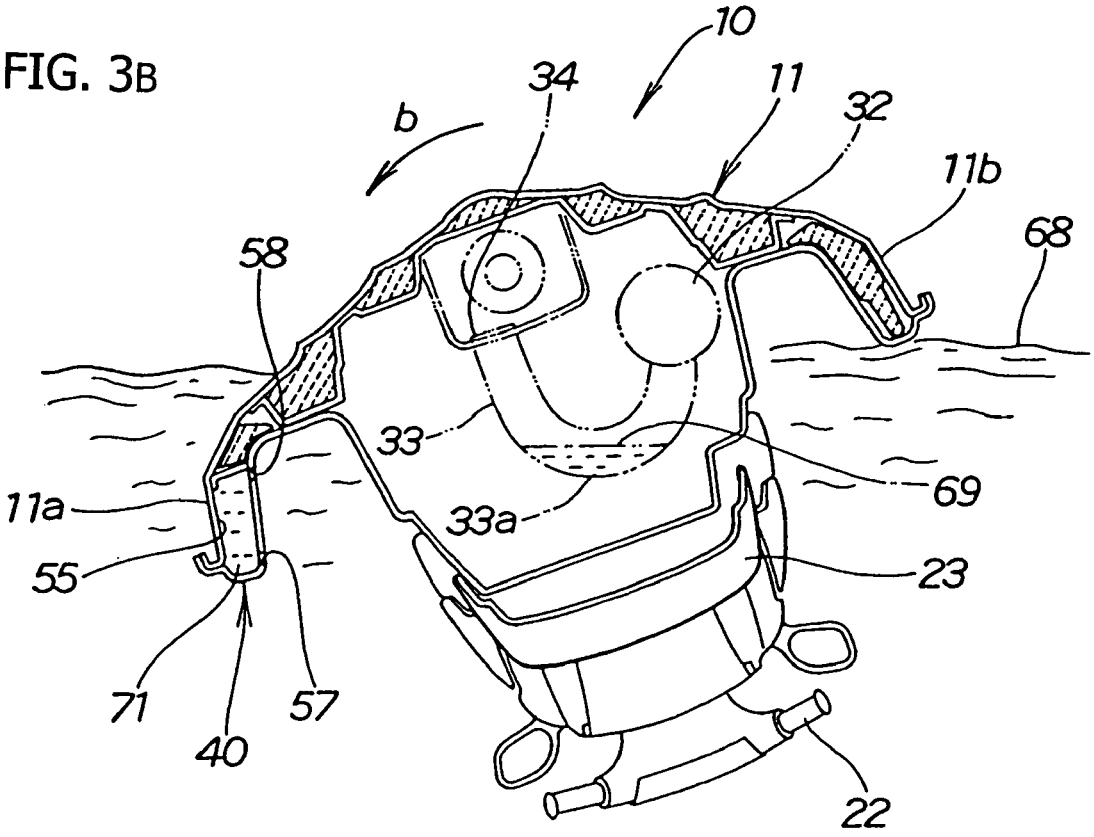

In operation, the personal watercraft 10 will be described with reference to FIGS. 3(*a*), 3(*b*), 4(*a*), 4(*b*), and 5. FIGS. 3(*a*) and 3(*b*) are views illustrating an exemplary case, in which the personal watercraft 10 according to the preferred embodiment of the present invention is overturned. Referring to FIG. 3(*a*), when the personal watercraft 10 is in an overturned state, the water-receiving portion 40 is located below the surface 68 of the water, or more specifically, is submerged under water. Since the water-receiving portion 40 is submerged under water, water flows into the water-receiving space 55 through the upper and lower through holes 57, 58 as shown by arrows a. It is to be noted herein that water 69 can enter the exhaust pipe 33 through the exhaust port 34, since in the overturned orientation, the exhaust port opens upwardly. The water 69 that has entered the exhaust pipe 33 collects at a vertex portion 33*a* of the exhaust pipe 33.

Referring to FIG. 3(*b*), water 71 collects in the water-receiving space 55. This makes the buoyancy at a right side portion 11*a* of the vessel body 11 less than the buoyancy at a left side portion 11*b* of the vessel body 11. Consequently, the personal watercraft 10 is inclined as shown by an arrow b to a condition, in which the right side portion 11*a* is lowered relative to the left side portion 11*b*.

Figure 4A:
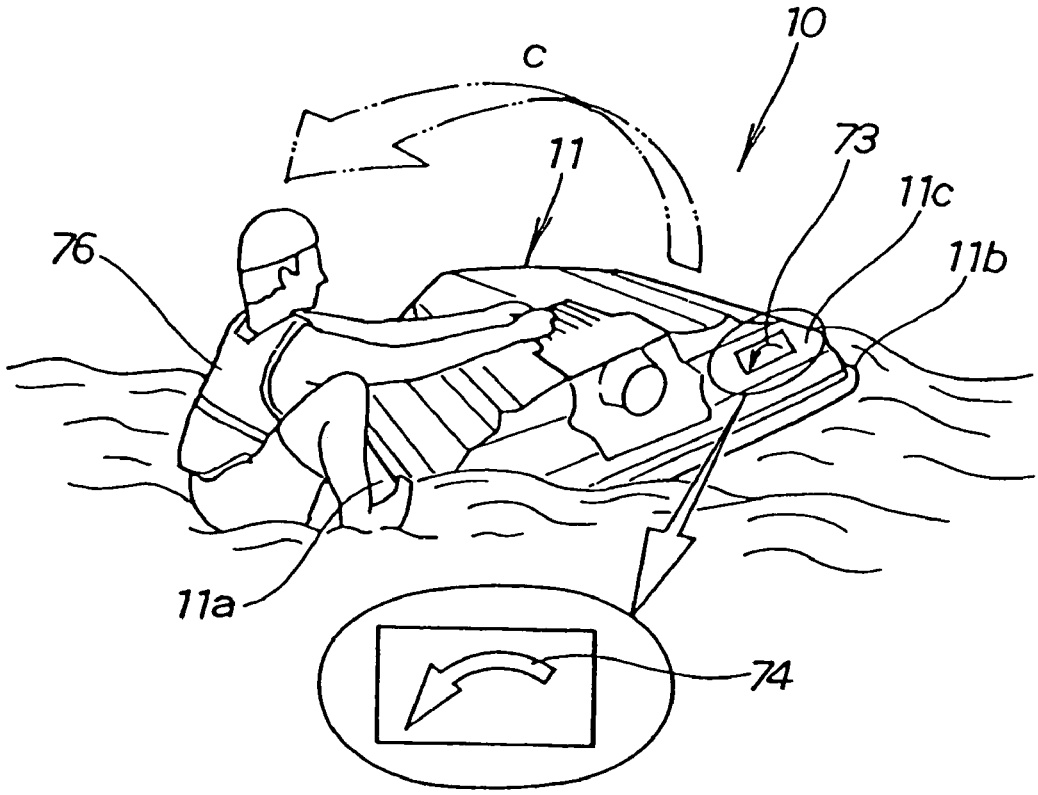
FIG. 4(*a*) is a rear perspective view of an operator applying force to one side of the exterior of the vessel body of the personal watercraft of FIG. 3*a* to cause a rotation of the vessel body in the direction of the arrow c.
Figure 4B:
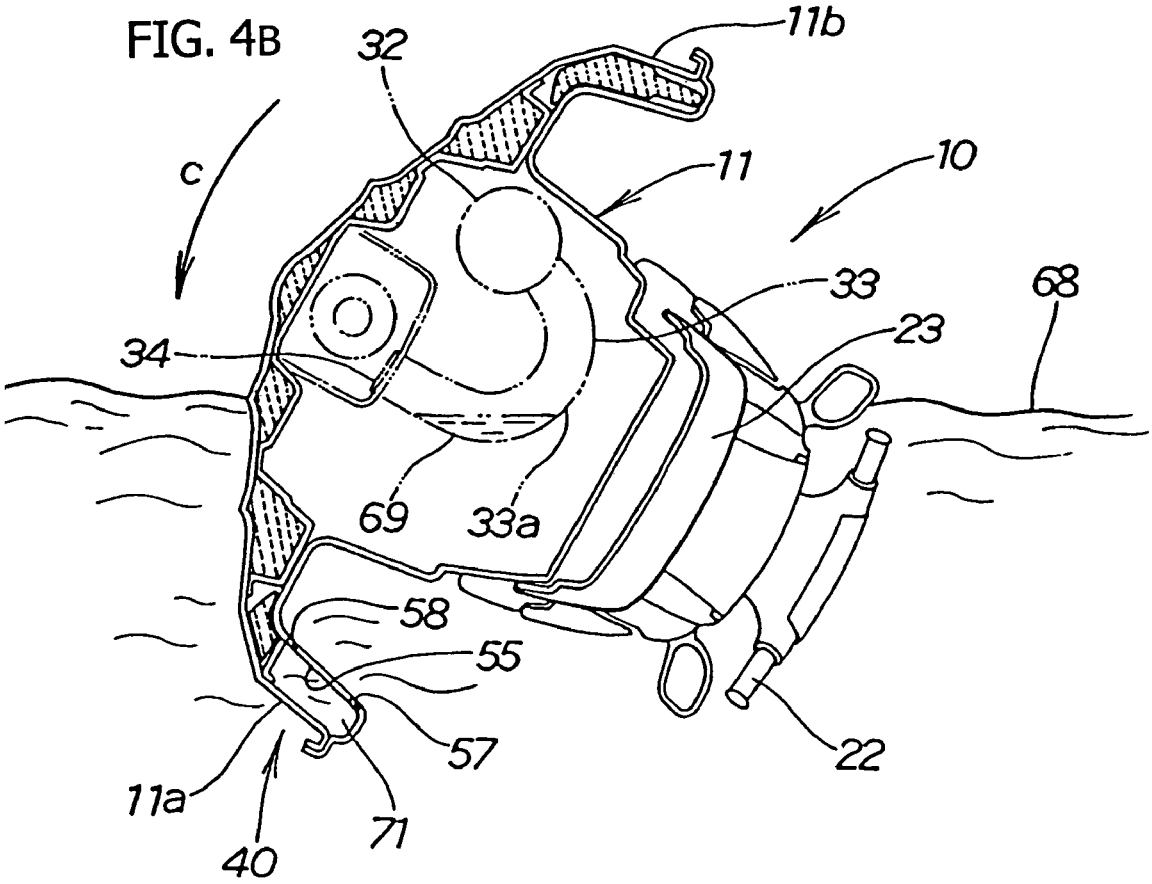

FIGS. 4(*a*) and 4(*b*) are views illustrating an exemplary case, in which the personal watercraft according to the preferred embodiment of the present invention is to be restored to a normal, upright position. Referring to FIG. 4(*a*), a sign plate 73 is disposed at a portion 11*c* in the rear on the left of the vessel body 11. The sign plate 73 indicates the correct direction of rotation to restore an overturned personal watercraft 10 to a normal, upright position. The correct direction of rotation is indicated, for example, by an arrow 74. The arrow 74 indicates a rotation through which the right side portion 11*a* is to be lowered relative to the left side portion 11*b*.

Disposing the sign plate 73 at the portion 11*c* in the rear on the left of the vessel body 11 allows the marking plate 73 to be located above the water surface 68, even when the personal watercraft 10 is inclined to a position in which the right side portion 11*a* of the personal watercraft 10 is lowered.

When attempting to restore the overturned personal watercraft 10 to a normal, upright position, an operator 76 verifies the direction of rotation by checking the sign plate 73. As instructed by the marking plate 73, the operator 76 rotates the personal watercraft 10 as shown by an arrow c in the direction of further lowering the right side portion 11*a*, which has been previously been lowered as a result of taking in water within the water-receiving space 55.

As described above, the operator 76 brings the overturned personal watercraft 10 to a normal, upright position by swiftly rotating the personal watercraft 10 in the correct direction which is the direction of further lowering the right side portion 11*a*, which has been previously been lowered as a result of taking in water within the water-receiving space 55.

It is to be noted herein that, since the right side portion 11*a* of the personal watercraft 10 has been in the lowered position when the overturned personal watercraft 10 is to be restored to the normal, upright position, it is more likely that the personal watercraft 10 will be brought to the normal position easily by further lowering the right side portion 11*a* than rotating the personal watercraft 10 in the other direction. Accordingly, it is considered that the operator 76 will normally rotate the personal watercraft 10 in the direction of further lowering the right side portion 11*a* in his or her attempt to restore the personal watercraft 10 to the normal, upright position.

Accordingly, even if the operator 76 is not aware of the correct direction of rotation, the operator 76 will rotate the personal watercraft 10 in the direction of further lowering the right side portion 11*a*. As a result, the operator 76 can restore the personal watercraft 10 to the normal, upright position by swiftly rotating the personal watercraft 10 in the correct direction.

Referring to FIG. 4(*b*), rotating the personal watercraft 10 in the direction of the arrow c such that the right side portion 11*a* is lowered causes the left side portion 11*b* of the vessel body 11 to be raised. As the muffler 32 moves upwardly, the exhaust port 34 moves downwardly. Consequently, the water 69 that has collected at the vertex portion 33*a* of the substantially inverted-U-shaped exhaust pipe 33 moves toward the side of the exhaust port 34.

Figure 5:
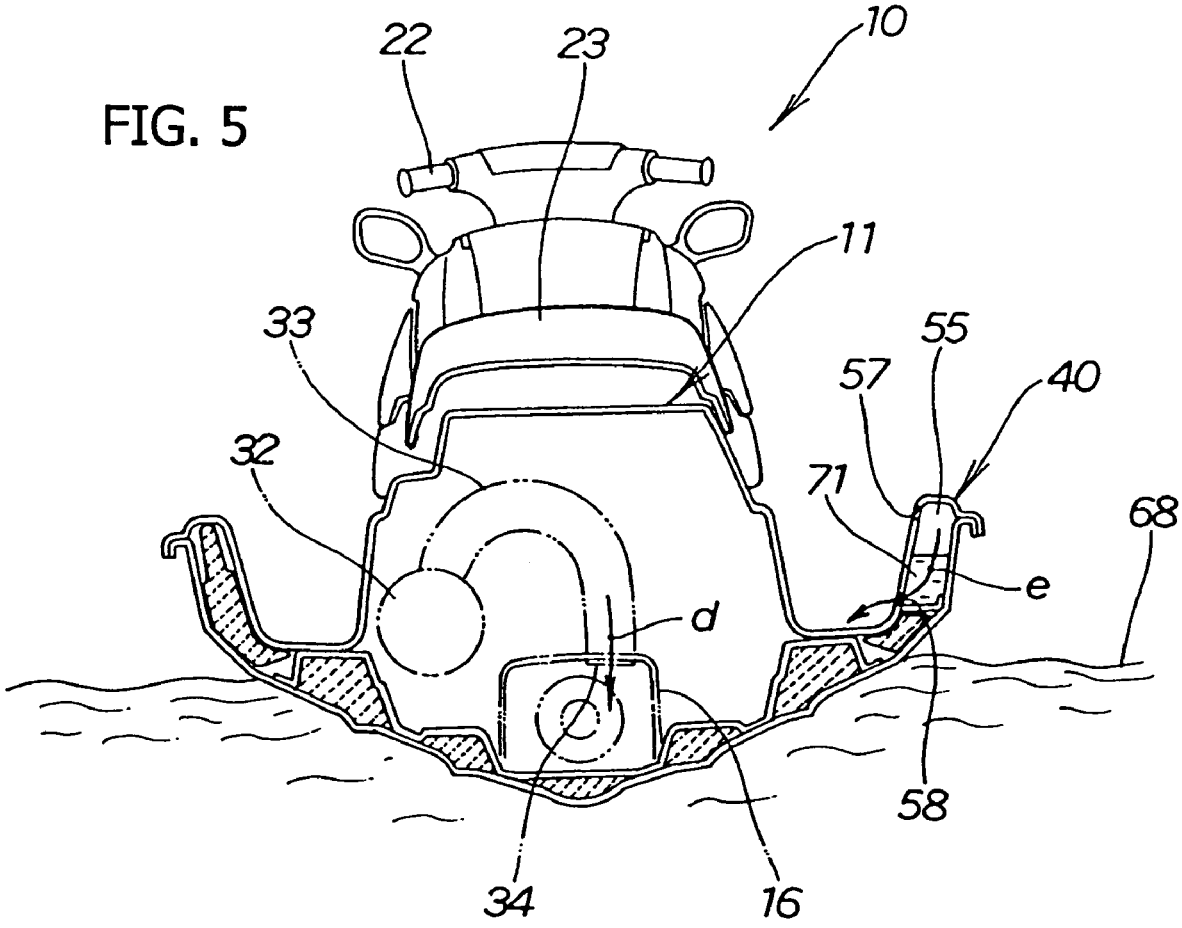
FIG. 5 is a cross-sectional view of the personal watercraft of FIG. 3*a* as viewed from the rear, showing the personal watercraft restored to the normal, upright position, and showing water flowing outward from the water-receiving space via a lower opening formed in the deck.
Figure 6:
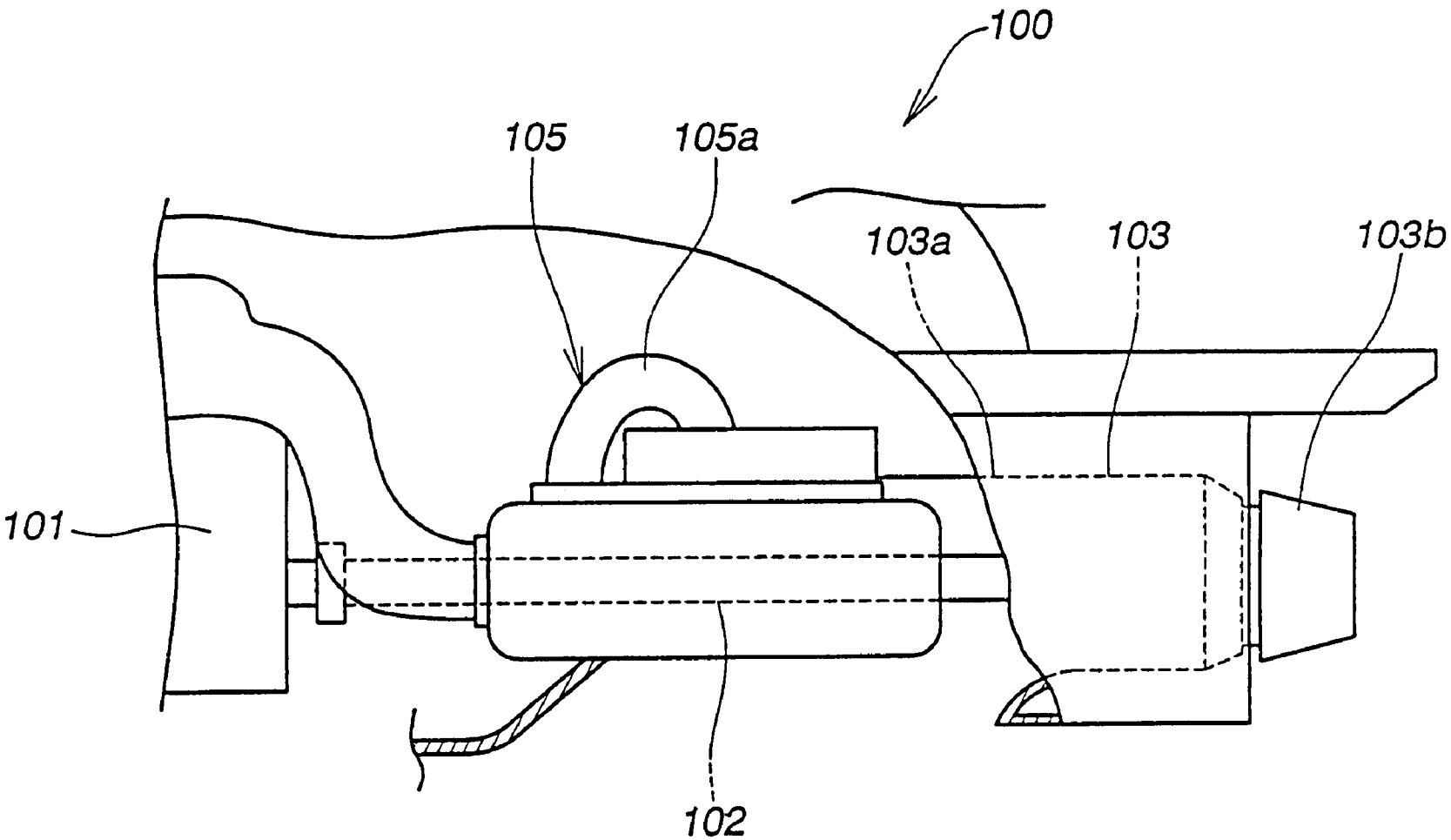
FIG. 6 PRIOR ART
FIG. 6 is an isolated view of a prior art exhaust system for a personal watercraft.

FIG. 5 is a view illustrating an exemplary case, in which the personal watercraft according to the preferred embodiment of the present invention has been restored to the normal, upright position. Bringing the personal watercraft 10 to the normal, upright position causes the exhaust port 34 to face downwardly, thus allowing the water 69 (see FIG. 4(*b*)) in the exhaust pipe 33 to be discharged to the pump chamber 16 from the exhaust port 34 as shown by an arrow d.

Further, with the personal watercraft 10 in the normal, upright position, the water-receiving portion 40 is located above the water surface 68. Accordingly, the water 71 that had been taken in the water-receiving space 55 is drained naturally by its own weight to the outside by way of the lower through hole 58, as shown by an arrow e. This permits a weight balance in a width direction of the personal watercraft 10 to be maintained in equilibrium when the personal watercraft 10 is operated. The personal watercraft 10 can thus be propelled in a favorable condition.

While the present invention has been described in the preferred embodiment, in which the muffler 32 is disposed in the left-hand side space 36 of the vessel body 11 and the water-receiving portion 40 is disposed at the right side portion 38 of the vessel body 11, it should be apparent to those skilled in the art that the arrangement is not limited thereto. The same effect can still be achieved by disposing the muffler 32 in a right-hand side space of the vessel body 11 and the water-receiving portion 40 at a left side portion of the vessel body 11.

Further, while the present invention has been described in the preferred embodiment, in which the water 71 taken in the water-receiving space 55 is subjected to natural drain of water through the lower through hole 58 with the personal watercraft 10 in the normal, upright position. It should be apparent to those skilled in the art that the arrangement is not so limited. It is perfectly possible to use discharge means, such as, for example, a bilge pump or the like for discharge the water. The bilge pump herein mentioned is a pump for drawing and discharging bilge (bilge water that collects at a hull bottom).

The present invention can be preferably applied to a personal watercraft having an inverted-U-shaped exhaust pipe in midway in an engine exhaust system, through which an exhaust gas is discharged out by way of an exhaust port.

While a working example of the present invention has been described above, the present invention is not limited to the working example described above, but various design alterations may be carried out without departing from the present invention as set forth in the claims.

We claim:

1. A personal watercraft comprising a vessel body having an intake port formed in a bottom portion thereof, a water jet propeller operatively attached to the vessel body, an engine mounted in the vessel body, and an exhaust system for the engine, wherein the exhaust system comprises:

a muffler;

an exhaust pipe connected to the muffler; and an exhaust port, wherein the exhaust pipe extends upwardly from the muffler a short distance and then curves to extend downwardly so as to be formed into a substantially inverted U-shape, wherein during operation of the engine, an exhaust gas in the muffler passes through the inverted U-shaped exhaust pipe and is discharged from the personal watercraft through the exhaust port;

wherein the muffler is disposed on a first side of the vessel body, and the exhaust port is disposed on a second side of the vessel body opposite the first side;

wherein the second side of the vessel body has a water-receiving space formed therein which is capable of taking in water, the water-receiving space being submersible under water when the personal watercraft is in an overturned state;

wherein the watercraft operates by drawing in water through the intake port and expelling the drawn-in water outwardly through the water jet propeller;

wherein said first and second sides are lateral sides of the vessel body;

wherein the watercraft is rotatable about an axis extending in a longitudinal direction thereof; and wherein a portion of the first side of the vessel body, symmetrically corresponding to the water-receiving space, has a buoyant material stored therein so that if the watercraft becomes capsized in a body of water, the vessel body will stabilize in an inclined orientation with the first side of the vehicle body oriented higher than the second side thereof.

2. The personal watercraft according to claim 1, wherein the vessel body is configured such that when the personal watercraft is floatably placed into a body of water and is oriented in a normal, upright position, the water-receiving space is located above the water and is configured to discharge water that has been taken therein.

3. The personal watercraft according to claim 1, wherein the vessel body comprises a hull which provides a lower surface of the vessel body, and a deck which provides an upper surface of the vessel body, with respective peripheral edges of the deck and hull being bonded together, and wherein a substantially horizontal partition is provided extending between the hull and the deck on the second side of the vessel body, the water-receiving space being disposed within the vessel body in a vacancy formed between the hull, the deck and the partition.

4. The personal watercraft according to claim 1, wherein the vessel body comprises a hull which provides a lower surface of the vessel body, and a deck which provides an upper surface of the vessel body, with respective peripheral edges of the deck and hull being bonded together, and wherein a substantially horizontal partition is provided extending between the hull and the deck on the second side of the vessel body, the water-receiving space being disposed within the vessel body in a vacancy formed between the hull, the deck and the partition, wherein the deck has a first through hole formed therein at an upper portion of the water-receiving space, and a second through hole formed therein at a lower portion of the water-receiving space, the first and second through holes permitting water to flow to and from the water-receiving space.

5. The personal watercraft according to claim 1, wherein the vessel body comprises a hull which provides a lower surface of the vessel body, and a deck which provides an upper surface of the vessel body, with respective peripheral edges of the deck and hull being bonded together, and wherein the first side of the vessel body has a buoyant material therein disposed in a space between the deck and the hull, and the second side of the vessel body has the water-receiving space formed therein and disposed between the deck and the hull.

6. A personal watercraft comprising a vessel body, an engine mounted in the vessel body, and an exhaust system for the engine, wherein the exhaust system comprises:

a muffler;

an exhaust pipe connected to the muffler; and an exhaust port, wherein the exhaust pipe extends upwardly from the muffler a short distance and then curves to extend downwardly so as to be formed into a substantially inverted U-shape, wherein during operation of the engine, an exhaust gas in the muffler passes through the inverted-U-shape exhaust pipe and is discharged from the personal watercraft through the exhaust port;

wherein the muffler is disposed on a first side of the vessel body, and the exhaust port is disposed on a second side of the vessel body opposite the first side;

wherein the second side of the vessel body has a water-receiving space formed therein which is capable of taking in water, the water-receiving space being submersible under water when the personal watercraft is in an overturned state;

wherein the vessel body comprises a hull which provides a lower surface of the vessel body, and a deck which provides an upper surface of the vessel body, with respective peripheral edges of the deck and hull being bonded together, wherein a substantially horizontal partition is provided extending between the hull and the deck on the second side of the vessel body, the water-receiving space being disposed within the vessel body in a vacancy formed between the hull, the deck and the partition, wherein a plate is mounted on an interior surface of the hull, and a plurality of buoyant members are disposed between the plate and the hull, and wherein an additional buoyant member is provided on the first side of the vessel body, adjacent to said bonded respective peripheral edges, in a space formed between the deck and the hull.

7. A method of righting an overturned personal watercraft in a situation where the watercraft has become overturned in a body of water, the personal watercraft comprising a vessel body, an engine mounted in the vessel body, and an exhaust system for the engine, wherein the exhaust system comprises:

a muffler;

an exhaust pipe connected to the muffler; and an exhaust port;

wherein the exhaust pipe extends upwardly from the muffler a short distance and then curves to extend downwardly so as to be formed into a substantially inverted U-shape, wherein during operation of the engine, an exhaust gas in the muffler passes through the inverted U-shaped exhaust pipe and is discharged from the personal watercraft through the exhaust port;

wherein the muffler is disposed on a first side of the vessel body, and the exhaust port is disposed on a second side of the vessel body opposite the first side;

wherein said first and second sides are lateral sides of the vessel body, and wherein the second side of the vessel body has a water-receiving space formed therein and capable of taking in water, the water-receiving space being submersible under water when the personal watercraft is in an overturned state, the method comprising the steps of:

a) permitting water to be taken into the water-receiving space of the vessel body;

b) observing the personal watercraft to determine a lowered side corresponding to the second side of the vessel body; and c) further lowering the second side of the vehicle body by applying pressure to the exterior of the vessel body to rotate the vehicle body about an axis of the watercraft extending in a longitudinal direction thereof, until the personal watercraft is righted.

8. The method of righting an overturned personal watercraft of claim 7, wherein the stern of the watercraft has a sign plate thereon bearing indicia indicating a correct direction of rotation for righting the personal watercraft when it is overturned;

the method further comprising a step of referring to the sign plate on the stern to verify the correct direction of rotation, prior to further lowering the second side of the personal watercraft.

9. The personal watercraft according to claim 1, wherein the water-receiving space is disposed above water when the watercraft is disposed in a body of water in a normal upright position, and wherein the water-receiving space is submerged under water when the watercraft is capsized, so that the water-receiving space then becomes filled with water causing the second side of the watercraft to sink lower in the water than the first side thereof, thereby indicating a recommended direction for rotation of the capsized watercraft about its longitudinal axis back to an upright position.

10. The personal watercraft according to claim 4, wherein the deck includes left and right foot portions which are receptacles for receiving respective feet of a user therein, and wherein said first and second through holes are formed in a portion of the deck which defines a side wall of one of said foot portions.

11. A personal watercraft comprising a vessel body, an engine mounted in the vessel body, and an exhaust system for the engine, wherein the exhaust system comprises:

a muffler;

an exhaust pipe connected to the muffler; and an exhaust port, wherein the exhaust pipe extends upwardly from the muffler a short distance and then curves to extend downwardly so as to be formed into a substantially inverted U-shape, wherein during operation of the engine, an exhaust gas in the muffler passes through the inverted-U-shaped exhaust pipe and is discharged from the personal watercraft through the exhaust port;

wherein the muffler is disposed on a first side of the vessel body, and the exhaust port is disposed on a second side of the vessel body opposite the first side; and wherein the second side of the vessel body has a water-receiving space formed therein which is capable of taking in water, the water-receiving space being submersible under water when the personal watercraft is in an overturned state;

wherein the vessel body comprises a hull which provides a lower surface of the vessel body, and a deck which provides an upper surface of the vessel body, with respective peripheral edges of the deck and hull being bonded together, and wherein a substantially horizontal partition is provided extending between the hull and the deck on the second side of the vessel body, the water-receiving space being disposed within the vessel body in a vacancy formed between the hull, the deck and the partition, wherein the deck has a first valveless through hole formed therein at an upper portion of the water-receiving space, and a second valveless through hole formed therein at a lower portion of the water-receiving space, the first and second through holes permitting water to flow to and from the water-receiving space.

12. The personal watercraft according to claim 11, wherein the deck includes left and right foot portions which are receptacles for receiving respective feet of a user therein, and wherein said first and second through holes are formed in a portion of the deck which defines a side wall of one of said foot portions.

* * * * *